US006322039B1

(12) United States Patent
De Luccia

(10) Patent No.: US 6,322,039 B1
(45) Date of Patent: Nov. 27, 2001

(54) SYSTEM AND STRUCTURE COMPRISING LEVELABLE FRAME AND INTEGRATED SECURITY MEANS

(76) Inventor: Carmen De Luccia, 7 Kime Ave., Wayne, NJ (US) 07470

( * ) Notice: Subject to any disclaimer, the term of this patent is extended or adjusted under 35 U.S.C. 154(b) by 0 days.

(21) Appl. No.: 09/632,122

(22) Filed: Aug. 3, 2000

(51) Int. Cl.[7] ..... F16M 13/00

(52) U.S. Cl. ..... 248/553; 248/222.14; 248/225.11; 248/231.91; 248/551

(58) Field of Search ..... 248/551, 553, 248/222.14, 222.52, 225.11, 231.91; 40/757

(56) References Cited

U.S. PATENT DOCUMENTS

| | | | | |
|---|---|---|---|---|
| 1,883,834 | * | 10/1932 | Turner . | |
| 2,448,213 | * | 8/1948 | Doonan . | |
| 3,952,436 | | 4/1976 | Kuhnke | 40/152.1 |
| 3,989,215 | * | 11/1976 | Weston | 248/224 |
| 4,385,744 | | 5/1983 | Sherman | 248/551 |
| 4,460,147 | * | 7/1984 | MacBain . | |
| 4,499,679 | | 2/1985 | Sherman | 40/152.1 |
| 4,606,526 | | 8/1986 | Rabinowitz | 248/489 |
| 4,903,934 | | 2/1990 | Fremstad | 248/551 |
| 5,209,449 | | 5/1993 | Hart | 248/475.1 |
| 5,425,525 | | 6/1995 | Cevasco | 258/551 |
| 5,961,090 | | 10/1999 | Parkin . | |

* cited by examiner

*Primary Examiner*—Ramon O. Ramirez
*Assistant Examiner*—Korie Chan
(74) *Attorney, Agent, or Firm*—William L. Muckelroy P.C.

(57) ABSTRACT

The present invention provides a system for the demountable secured attachment of an article such as a painting or other artwork, or the like, to a supporting surface, such as a wall. The system comprises an elongated mounting bracket with a mounting portion and mounting means for engagement with the support surface, and which is vertically adjustable, and an interconnection portion. The system also comprises an article attachment member, also an elongated bracket, with an article attachment portion and attachment means for attachment to the artwork or other article, and an interconnection portion for demountable mating engagement with the interconnection portion of the support surface attachment member. The system also comprises at least one securing assembly comprising a support surface mounted member for fixed attachment to the support surface, comprising a "T"-screw, that is, a screw with its head in the shape of a solid rectangle, and an article mounted member comprising means for attachment to the article, and means for receiving and demountably engaging the head of the "T"-screw comprising a slot to admit the head of the "T"-screw when the "T"-screw is aligned in a horizontal orientation, and engage the head of the "T"-screw when the head of the "T"-screw is vertically oriented. In addition, the system comprises a tool for the rotational orientation of the head of the "T"-screw.

3 Claims, 4 Drawing Sheets

SYSTEM AND STRUCTURE COMPRISING LEVELABLE FRAME AND INTEGRATED SECURITY MEANS

BACKGROUND OF INVENTION

1. Field of the Invention

The present novel invention relates to a levelable secured system for hanging wood and metal frames to a wall.

2. Description of Related Art

In the past, it has been common to hang framed pictures and paintings or other artworks and the like onto a wall, and if the value of the artwork warranted, to secure the frame to the wall in some locking fashion. A number of methods for this are known to the prior art, including the following.

U.S. Pat. No. 3,952,436 issued to Kuhnke on Apr. 27, 1976. This reference is entitled Device For Locking A Framed Picture To A Wall and is not assigned of record. The reference shows a generally disk shaped device with an extending arm which engages a part of a picture frame in its locked position and holds the frame against the wall. The device also prevents lateral and upward movement of the frame.

U.S. Pat. No. 4,385,744 issued to Sherman and Nielsen on May 31, 1983. This reference is entitled Anti-theft Frame Hanging System and is assigned of record to the Nielsen Moulding Design Corporation of Townsend, Mass. This reference shows a frame apparatus including a frame body for retaining a display article and a securing system fixed to a support surface and detachably engagable with the rear surface of the frame body. The securing system includes a latch assembly attaching the frame body to the support surface and having a release mechanism concealed therebetween. Because the latch release mechanism is concealed from view, unauthorized removal of the frame body from the support surface is deterred.

U.S. Pat. No. 4,499,679 issued to Sherman on Feb. 19, 1985. This reference is entitled Anti-Theft Frame Hanging System and is assigned of record to the Nielsen Moulding Design Corporation, of Townsend, Mass. This reference shows a frame body for retaining a display article and having a rear surface that can be releasably secured to a support surface. Included in the invention is a releasable latch mechanism for attaching the rear surface to the support surface and movable between a locked position preventing removal of the frame body from the support surface and a release position allowing removal thereof. The latch mechanism comprises a release means disposed between and substantially concealed by the frame body and the support surface and operable to move the latch mechanism to the release position so as to allow removal of the frame body. Also included in the invention is a plurality of spaced apart catch brackets for mounting on the support surface and adapted to releasably engage the rear surface and to be completely retained within receptacles defined thereby. The concealed latch mechanism provides attachment security and the receptacle retained catch brackets facilitate use of the invention with a frame body composed of rearwardly opening channels that form an outer periphery for the display article.

U.S. Pat. No. 4,606,526 issued to Rabinowitz on Aug. 19, 1986. This reference is entitles Frame Hanger and is not assigned of record. This reference shows a picture frame hanger that comprises a block of plastic, wood or metal having at least one lateral projection defining a lip receivable into the groove or channel of a picture frame. The lip may be parallelepiped in form, or comprise a beveled surface with the bevel diverging in the direction opposite the support wall. In the preferred embodiment the hanger included both parallelepiped and beveled projections on alternate edges for a more flexible device.

U.S. Pat. No. 4,903,934 issued to Fremstad on Feb. 27, 1990. This reference is entitled Picture Frame Fastening Means and is not assigned of record. This reference shows a picture frame locking device that also permits the precise marking of a wall for fastener insertion. The device comprises a base that attaches to a wall, and includes locking members rotatable into overlying relationship with flanges in the tubular metal frame. A tool can provide rotation of the locking members into locked positions.

U.S. Pat. No. 5,209,449 issued to Hart on May 11, 1993. This reference is entitled Apparatuses And Method For Hanging Frames and in not assigned of record. This reference shows an apparatus that is securely attached to a mounting surface, such as a wall, and upon which a frame is hung. The apparatus has a generally planar body with a protruding supporting rail, and includes alignment notches, a spirit level, bracket recess, and mounting holes. The supporting rail is intended for engagement with the universal Bassembly channels of commercial metal frames.

U.S. Pat. No. 5,425,525 issued to Cevasco on Jun. 20, 1995. This reference is entitled Anti-Theft Device and is assigned of record to Vantine Studios of Hamilton, New York. This reference shows a two member mounting device in which one member is mounted to a wall and the other member is attached to the back of a picture frame or plaque. The two members inter-engage one another and a padlock may be attached to prevent separation, thus securing the picture frame or plaque to the wall.

U.S. Pat. No. 5,961,090 issued to Parkin Oct. 5, 1999. This reference is entitled Mounting Device and is not assigned of record. This reference shows a mounting device for mounting an article on or against a supporting structure, such as a wall. The device includes a securing portion and an elongate support portion. The securing portion has one or more securing formation configured to be securable to the support structure. The support portion has one or more support formation extending along its length arranged on a plane at an angle to the securing plane of the securing formation.

BRIEF SUMMARY OF THE INVENTION

Objects of the Invention

It is an object of the present novel invention to provide a system for the secured attachment of an article such as a painting or other artwork to a support surface such as a wall.

It is a further object of the present novel invention to provide a system for the secured attachment of an article such as a painting or other artwork in a wooden frame to a support surface such as a wall.

It is a still further object of the present invention to provide a system for the secured attachment of an article such as a painting or other artwork in a metal frame to a support surface such as a wall.

It is another object of the present novel invention to provide a system for the secured attachment of an article such as a painting or other artwork to a support surface such as a wall, which permits demounting the article when desirable.

SUMMARY OF THE INVENTION

According to a preferred embodiment of the present novel invention, there is provided a system for the demountable secured attachment of an article to a supporting surface, which system comprises:

a. a support surface attachment member comprising an elongated mounting bracket comprising:
   1) a mounting portion for engagement with a support surface, said mounting portion further comprising mounting means adapted to fixedly engage said support surface, said mounting portion being vertically adjustable, and
   2) an interconnection portion, b. an article attachment member comprising an elongated attachment bracket comprising:
   1) an article attachment portion for engagement with an article, said article attachment portion further comprising attachment means to fixedly engage said article, and
   2) an interconnection portion intended for demountable mating engagement with said interconnection portion of said support surface attachment member;

c. at least one securing assembly comprising:
   1) a support surface mounted member for fixed attachment to a support surface comprising a "T"-screw, a screw with a head in the shape of a "T",
   2) an article mounted member comprising:
      a) means for attachment of said article mounted member to an article, and
      b) means for receiving and demountably engaging said support surface mounted member comprising a slot of dimension to admit the head of said "T"-screw when the head of said "T"-screw is aligned in a horizontal orientation, and matingly engage the head of said "T"-screw when the head of said "T"-screw is vertically oriented; and, d. a tool for the rotational orientation of the head of said "T"-screw.

BRIEF DESCRIPTION OF THE SEVERAL VIEWS OF THE DRAWINGS

That the foregoing and other features and advantages of the present invention are evident upon a prima facie application of the doctrine of equivalents will be understood from the detailed description of its novel aspects, as further disclosed herein, when taken in conjunction with the following drawings, wherein.

DETAILED DESCRIPTION OF THE INVENTION

Figure 1:
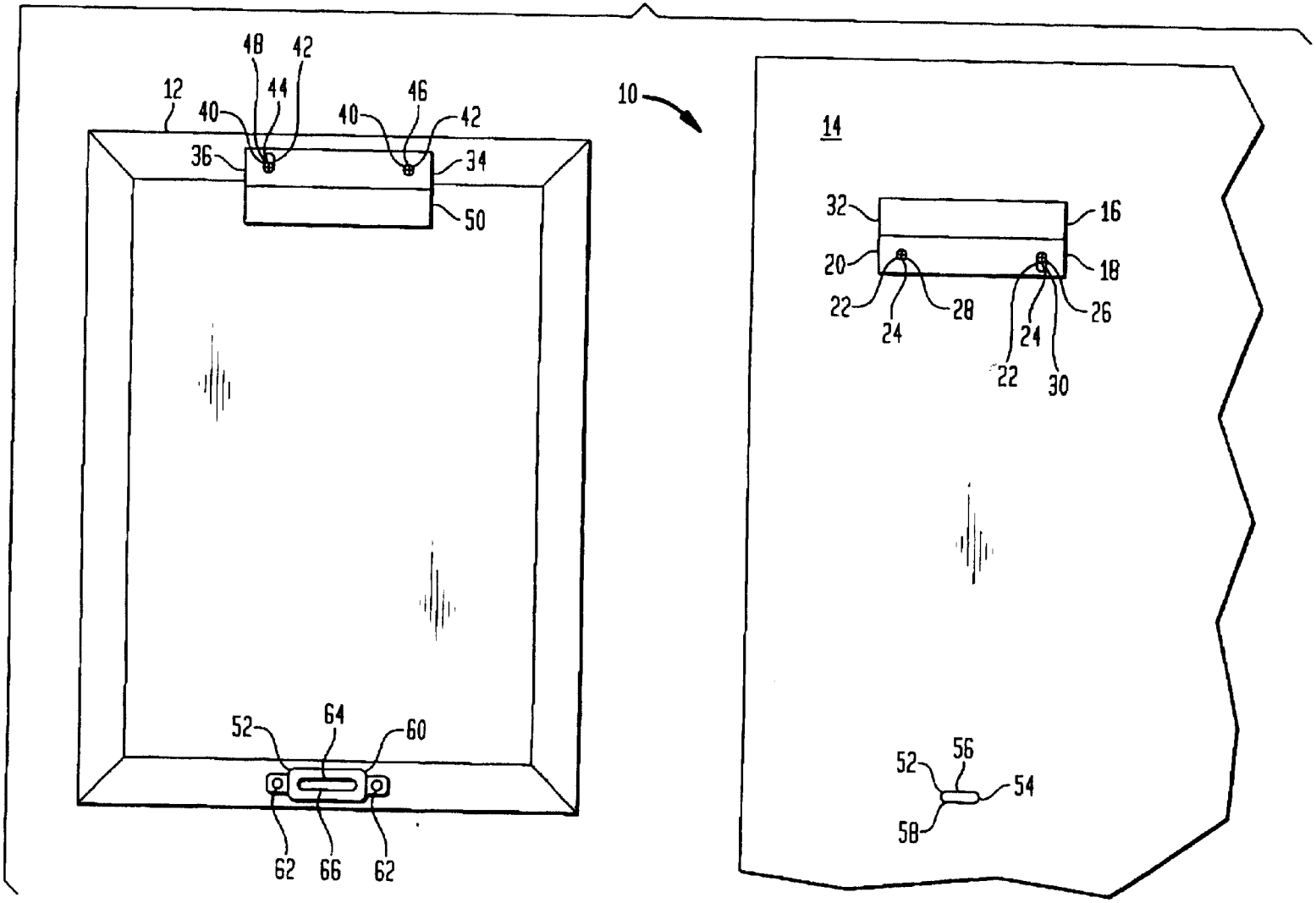
FIG. 1 is a multi-view drawing of the Levelable Frame and Integrated Security Means of the present invention.

FIG. 1 is a multi-view drawing of the System and Structure Comprising Levelable Frame and Integrated Security Means of the present invention. This system (10), and the structure of the various component elements, is shown therein. With reference to FIG. 1, the present novel invention comprises a system (10) for the demountable secured attachment of an article (12), such as a painting, or framed photograph, or other work of art, or the like, shown from the rear, to a supporting surface (14), such as a wall, or the like.

The system (10) illustrated in FIG. 1, comprises a number of elements. One of these elements is a support surface attachment member (16). In the illustrated embodiment, the support surface attachment member (16) comprises an elongated mounting bracket (18) that can be fixedly attached to the support surface (14). This bracket (18) comprises a mounting portion (20) for engagement with a support surface (14), and this mounting portion further comprises mounting means (22) adapted for fixed engagement to the support surface (14). As illustrated in the preferred embodiment of the present novel invention, such mounting means (22) can be provided by two holes, at positions (24) through the mounting portion (20) of mounting bracket (18). Further, it is believed that two screws (26) and (28), will typically serve the purpose of fixedly attaching the mounting bracket (18), although the composition of some support structures (14) may require screw anchors, or some other method of mounting.

In the preferred embodiment of the present novel invention, one of the holes comprising the mounting means (22) should comprise a vertical slot (30), and the position of a screw (26) within that slot (30), when tightened into the supporting surface (14), will determine the vertical adjustment of the mounting bracket (18). In this manner, the support surface attachment member (16) can be vertically adjustable.

The support surface attachment member (16) further comprises an interconnection portion (32), that is spaced apart from the supporting surface (14) when the support surface attachment member (16) is affixed. The operation of this interconnection portion (32) will be described more fully hereinafter.

Another element of the system (10) of the present novel invention is an article attachment member (34). This article attachment member (34) is intended for attachment to an article (12) such as a painting, framed photograph, some other artwork, or the like. The article attachment member (34) comprises an elongated attachment bracket (36) further comprising an article attachment portion (38) for engagement with an article (12). This article attachment portion (38) illustrated in FIG. 2, includes attachment means (40) to fixedly engage the article attachment member (34) to the article (14).

Figure 2:
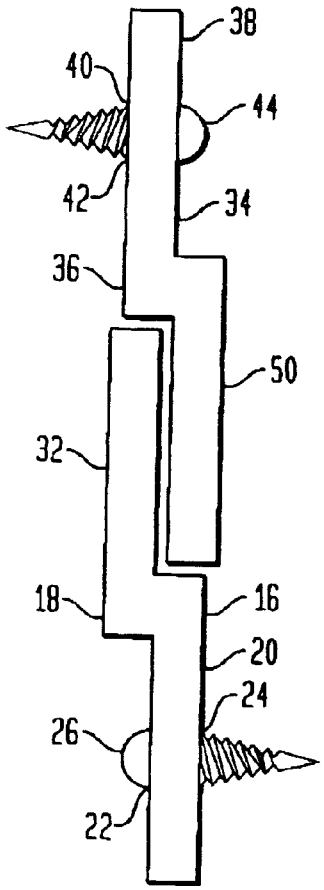
FIG. 2 is an illustration of the engagement of the interconnection portions of the support surface attachment member and the article attachment member of FIG. 1.

As illustrated in the preferred embodiment of the present novel invention shown in FIG. 2, such attachment means (40) can be provided by two holes through the attachment portion (38) of attachment bracket (36) at positions (42). Further, it is believed that two screws (44) and (46), will typically serve the purpose for fixedly attaching the attachment bracket (36), particularly for an article (12) with a wooden frame.

With further reference to the preferred embodiment of the present novel invention shown in FIG. 1, one of the holes comprising the attachment means (40) should comprise a vertical slot (48), and the position of a screw (44) within that slot (48), when tightened into the article (12), will determine the vertical adjustment of the attachment bracket (36). In this manner, the article attachment member (34) can be vertically adjustable.

The article attachment member (34) of the present invention is further provided with an interconnection portion (50) intended for demountable mating engagement with the interconnection portion (32) of the support surface attachment member (16). The interconnection portion (50) of the article attachment member (34) is spaced apart from the article (12) when the article attachment member (34) is affixed.

The mating engagement of the interconnection portion (32) of the support surface attachment member (16) and the interconnection portion (50) of the article attachment member (34) can be seen in detail in FIG. 2. That figure represents a side view to show detail. In that figure, the support surface attachment member (16) comprises a mounting portion (20) that would mount to a support surface, with screw (26) engaging said support surface. Interconnection portion (32) of the support surface attachment member (16) is shown spaced apart from the plane in which the mounting portion (20) of the support surface attachment member (16) would meet the support surface. At the same time, the article attachment member (34) comprises an article attachment portion (38) that would mount to an article, with screw (44) engaging that article. Interconnection portion (50) of the article attachment member (34) is shown spaced apart from the plane in which the article attachment portion (38) of the article attachment member (34) would meet the article.

As seen in FIG. 2, the spaced apart nature of each interconnection member accommodates the other interconnection member when the two are brought into mating engagement, and provides support for an article on a support surface.

One skilled in the art will also recognize that the practice of the invention is simplified somewhat if the support surface attachment member (16) and the article attachment member (34) are identical pieces in an opposite vertical orientation.

Referring again to FIG. 1, another element of the system (10) of the present novel invention is at least one securing assembly (52) comprising a support surface mounted member (54) for fixed attachment to a support surface (14). In the preferred embodiment of the present invention, the support surface mounted member (54) comprises a "T"-screw (56), that is, a screw with a head (58) in the shape of a "T". This "T"-screw (56) is screwed into the support surface (14) at the proper location with its "T"-shaped head (58) a small distance from the support surface (14).

Figure 3:
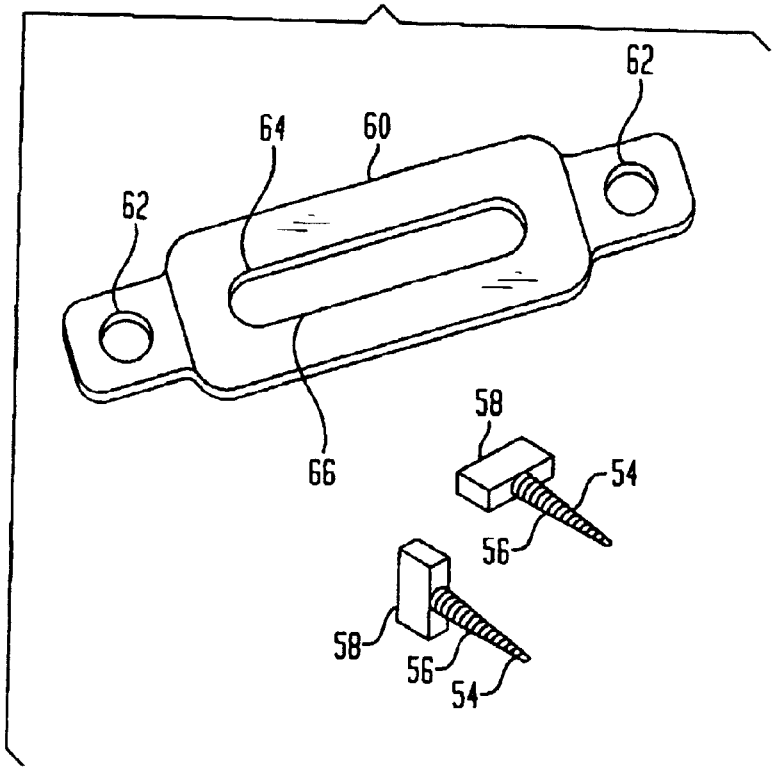
FIG. 3 is an oblique view of the article mounted member and two views of the support surface mounted member of the present invention.

The securing assembly (52) of the present invention further comprises an article mounted member (60). This article mounted member (60) comprises attachment means (62) for the attachment of the article mounted member (60) to an article (12). Further, the article mounted member (60) is provided with engagement means (64) for receiving and demountably engaging the support surface mounted member (54). In the illustrated embodiment, this engagement means (64) comprises a slot (66) of dimension to admit the "T"-screw head (58) when that "T"-screw (56) is aligned in a horizontal orientation, and matingly engage the "T"-screw head (58) when said "T"-screw (56) is vertically oriented. These components are shown in greater detail in FIG. 3.

Figure 4:
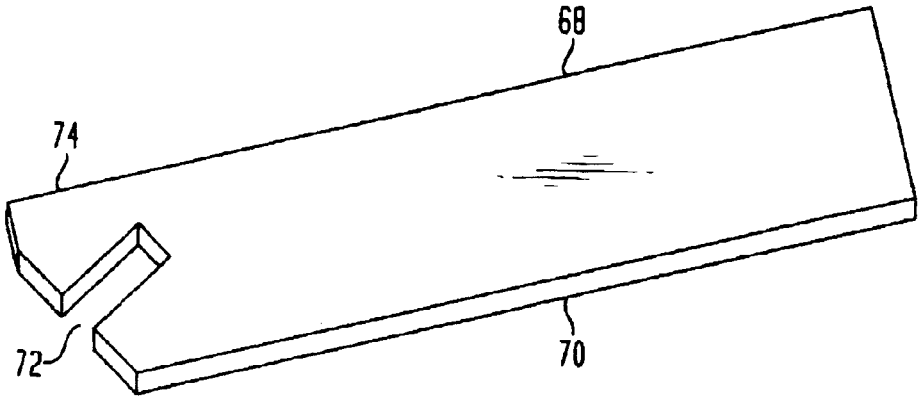
FIG. 4 shows a tool for use in securing the support surface mounted member within the article mounted member of the present invention or the metal channel molding of a metal frame.

FIG. 4 shows a tool (68) for the rotational orientation of said "T"-screw (56). This tool (68), in a simplistic form, is a flat metal bar (70) with a notch (72) at one end (74) thereof. The tool (68) is intended to fit between the article mounted member (60) and the article (12) when the "T"-screw head (58) in its horizontal orientation has passed through the slot (66) in the article mounted member (60). When this has been accomplished, the notch (72) at the end (74) of tool (68) can engage the "T"-screw head (58) and the tool (68) can be used to rotate the "T"-screw head (58) approximately ninety degrees to a vertical orientation, engaging the securing assembly (52).

The foregoing explanation is most appropriate for articles with wooded frames, and is useful in the demountable secured attachment of a wood-framed article to a supporting surface. As such, the attachment means that have been described have been screws, which would engage the wooden frame. One skilled in the art will recognize that other means of attachment are possible, and may be preferable in various applications. Likewise, screws may be used in the attachment to a metal framed article, but other methods are typically preferred.

Most metal frames today are constructed from a standard form of metal molding, and the system of the present invention is uniquely able to provide for the secured demountable attachment of a metal-framed article, as will be described hereinafter. In this regard, there is shown in FIG. 5 a system (110) for the demountable secured attachment of a metal-framed article (112), shown from the rear, to a supporting surface (114), such as a wall.

Figure 5:
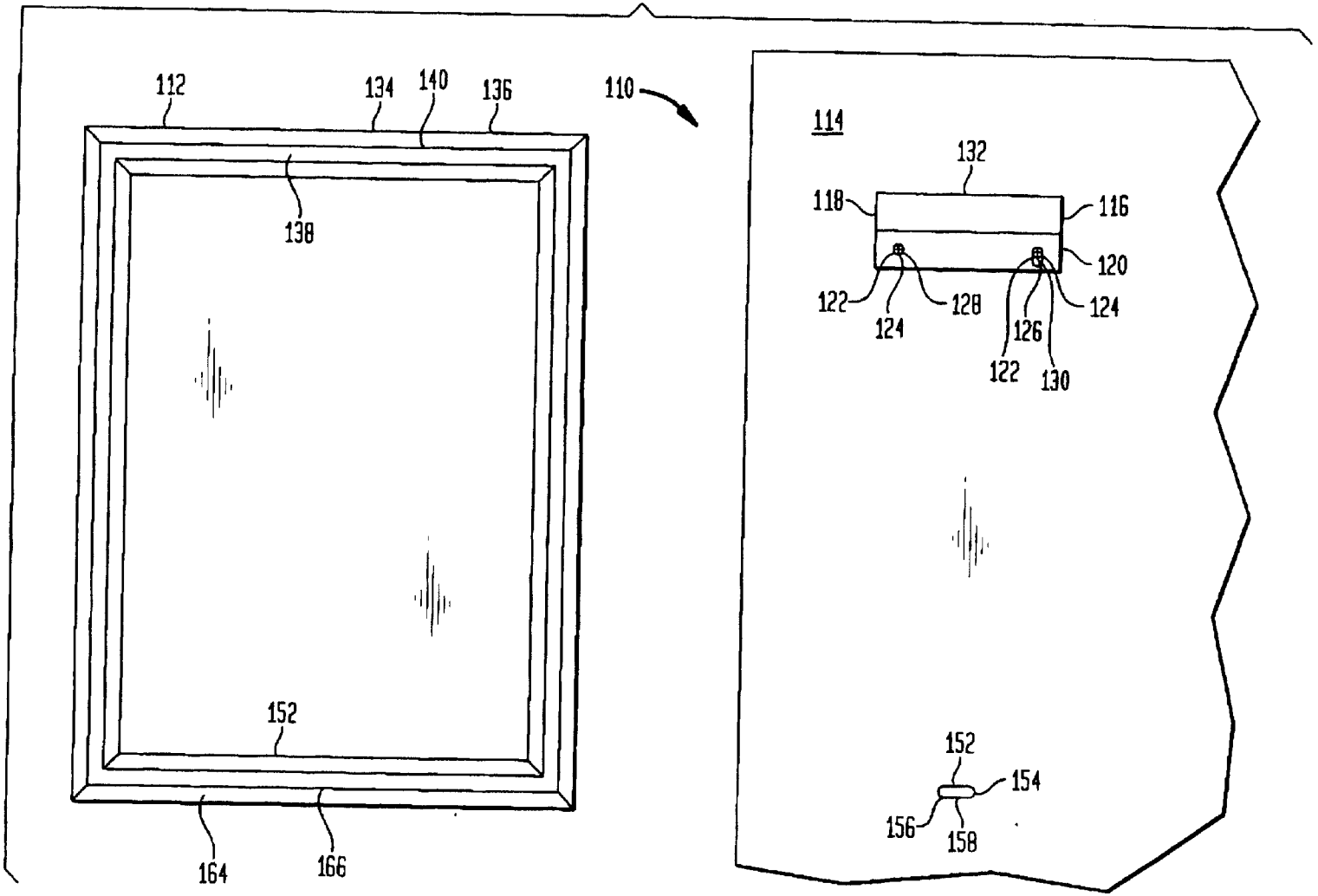
FIG. 5 is a multi-view drawing of the Levelable Frame and Integrated Security Means of the present invention in use with a metal frame.

The system (110) illustrated in FIG. 5, comprises a number of elements. One of these elements is a support surface attachment member (116). In the illustrated embodiment, the support surface attachment member (116) comprises an elongated mounting bracket (118) that can be fixedly attached to the support surface (114). This bracket (118) comprises a mounting portion (120) for engagement with a support surface (114), and this mounting portion further comprises mounting means (122) adapted to fixed engagement to the support surface (114). As illustrated in the preferred embodiment of the present novel invention, such mounting means (122) can be provided by two holes, at positions (124) through the mounting portion (120) of mounting bracket (118). Further, it is believed that two screws (126) and (128), will typically serve the purpose for fixedly attaching the mounting bracket (118), although the composition of some support structures (114) may require screw anchors, or some other method of mounting.

In the preferred embodiment of the present novel invention, one of the holes comprising the mounting means (122) should comprise a vertical slot (130), and the position of a screw (126) within that slot (130), when tightened into the supporting surface (114), will determine the vertical adjustment of the mounting bracket (118). In this manner, the support surface attachment member (116) can be vertically adjustable.

The support surface attachment member (116) further comprises an interconnection portion (132), that is spaced apart from the supporting surface (114) when the support surface attachment member (116) is affixed. The operation of this interconnection portion (132) will be described more fully hereinafter.

Figure 6:
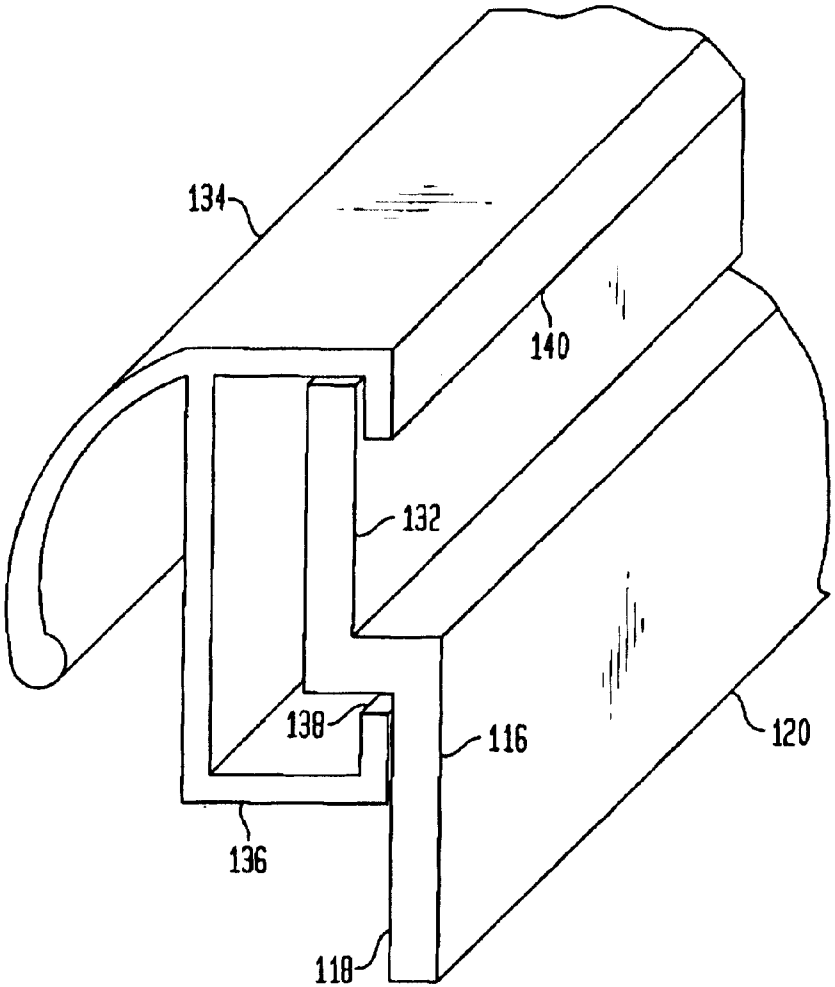
FIG. 6 is an illustration of the engagement of the interconnection portion of the support surface attachment member and the metal channel molding of the metal frame of FIG. 5.

What makes the requirements of a metal-framed article (112) unique, however, is the use of a standard metal channel molding (134) in its construction. Such a standard metal channel molding (134) is shown in FIG. 6. As seen therein, the metal channel molding (134) has a cross-section with an open-boxed portion (136) with the opening (138) facing rearward, and a depending rim (140). The nature of this construction permits the metal channel molding to serve as an article attachment means, and the depending rim (140) to serve as an interconnection portion, engaging the interconnection portion (132) of the support surface attachment member (116). This engagement is shown in greater detail in FIG. 6.

Referring again to FIG. 5, another element of the system (110) of the present novel invention is at least one securing assembly (152) comprising a support surface mounted member (154) for fixed attachment to a support surface (114). In the preferred embodiment of the present invention, the support surface mounted member (154) comprises a "T"-screw (156), that is, a screw with a head (158) in the shape of a solid elongated rectangle with six surfaces. The "screw" part of the T-screw extends from one of the two largest surfaces. This "T"-screw (156) is screwed into the support surface (114) at the proper location with its "T"-shaped head a small distance from the support surface (114).

Figure 7:
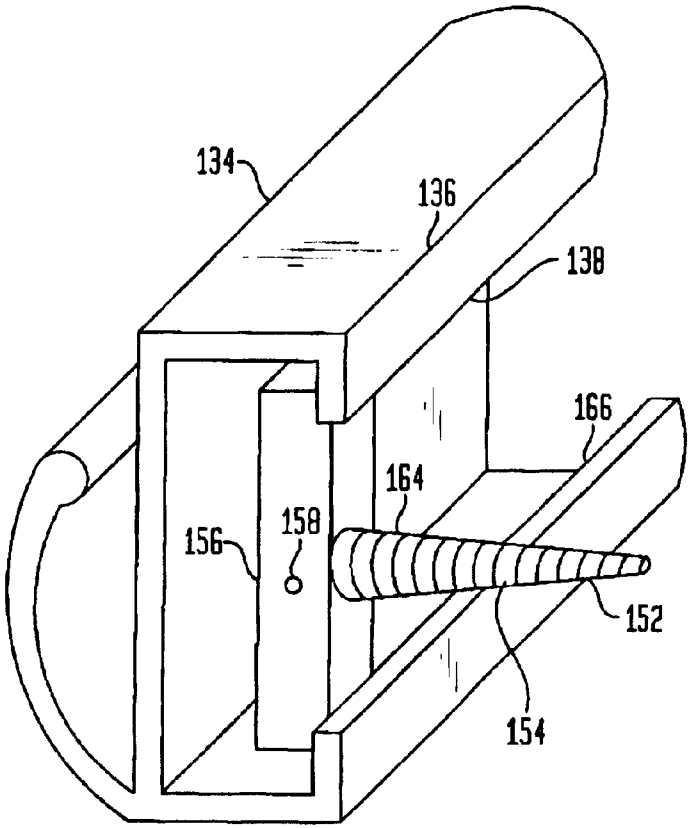
FIG. 7 shows greater detail of the engagement of the metal channel molding of the metal frame, and the support surface mounted member of the securing assembly of the present invention.

The nature of the standard metal channel molding (134) also provides an engagement means (164) for receiving and demountably engaging the support surface mounted member (154). In the illustrated embodiment, this engagement means (164) comprises a now upward-facing rim (166) of dimension to admit into the open-boxed portion (136) of the metal channel molding (134) the "T"-screw head (158) when that "T"-screw (156) is aligned in a horizontal orientation, and matingly engage the "T"-screw head (158) when said "T"-screw (156) is vertically oriented. The above-referenced components are shown in greater detail in FIG. 7.

Again, FIG. 4 shows a tool (68) for the rotational orientation of the head of said "T"-screw (156). This tool (68) in a simplistic form is a flat metal bar (70) with a notch (72) at one end (74) thereof. When the "T"-screw head (158) in its horizontal orientation has passed beyond the upward-facing rim (166) into the open-boxed portion (136) of the metal channel molding (134), the notch (72) at the end (74) of tool (68) can engage the "T"-screw head (158) and the tool (68) can be used to rotate the "T"-screw head (158) approximately ninety degrees to a vertical orientation, engaging the securing assembly (152).

It is within the scope of this invention that one skilled in this art may adapt the system disclosed herein for particular types of articles and supporting structures.

Thus, it can be seen from the foregoing description of the currently preferred embodiments and the following claims that a new and useful system and structure for the levelable secured hanging of wood and metal frames to a wall, and the system has been illustrated and described and that modification, equivalents and changes can be made therein by persons of ordinary skill without departing from either the scope of the claims or the spirit of the novel invention.

10. System
12. Article
14. Supporting Surface
16. Support Surface Attachment Member
18. Elongated Mounting Bracket
20. Mounting Portion
22. Mounting Means
24. Position For Holes
26. Screw
28. Screw
30. Slot
32. Interconnection Portion
34. Article Attachment Member
36. Elongated Attachment Bracket
38. Article Attachment Portion
40. Attachment Means
42. Positions For Holes
44. Screw
46. Screw
48. Vertical Slot
50. Interconnection Portion
52. Securing Assembly
54. Support Surface Mounted Member
56. T-screw
58. T-screw Head
60. Article Mounted Member
62. Attachment
64. Engagement Means
66. Slot
68. Tool
70. Flat Metal Bar
72. Notch
74. One End
110. System
112. Metal-Framed Article
114. Supporting Surface
116. Support Surface Attachment Member
118. Elongated Mounting Bracket
120. Mounting Portion
122. Mounting Means
124. Positions For Holes
126. Screw
128. Screw
130. Slot
132. Interconnection Portion
134. Metal Channel Molding
136. Open-Boxed Portion
138. Opening
140. Depending Rim
152. Securing Assembly
154. Support Surface Mounted Member
156. T-screw
158. T-screw Head
164. Engagement Means
166. Upward-Facing Rim

What is claimed is:

1. A system for the demountable secured attachment of an article to a supporting surface, which system comprises:

a support surface attachment member comprising an elongated mounting bracket comprising:

1) a mounting portion for engagement with a support surface, said mounting portion further comprising mounting means adapted to fixedly engage said support surface, said mounting portion being vertically adjustable, and 2) an interconnection portion;

an article attachment member comprising an elongated attachment bracket comprising:

3) an article attachment portion for engagement with an article, said article attachment portion further comprising attachment means to fixedly engage said article, and 4) an interconnection portion intended for demountable mating engagement with said interconnection portion of said support surface attachment member, at least one securing assembly comprising:

5) a support surface mounted member for fixed attachment to a support surface comprising a "T"-screw, a screw with a head in the shape of a "T", 6) an article mounted member comprising:

a) means for attachment of said article mounted member to an article, and b) means for receiving and demountably engaging said support surface mounted member comprising a slot of dimension to admit the head of said "T"-screw when said "T"-screw is aligned in a horizontal orientation, and matingly engage the head of said "T"-screw when the head of said "T"-screw is vertically oriented; and, a tool for the rotational orientation of the head of said "T"-screw.

2. A system for the demountable secured attachment of a wood-framed article to a supporting surface, which system comprises:

a. a support surface attachment member comprising an elongated mounting bracket having opposed ends and comprising:

1) a mounting portion for engagement with a support surface, said mounting portion further comprising mounting means adapted to fixedly engage said support surface comprising two holes through said mounting portion of said support surface attachment member proximate to the ends thereof and an equal number of screws selected to matingly engage said holes and fixedly engage said support surface, and wherein one of said holes comprises a vertical slot permitting vertical movement of one end of said support surface attachment means, permitting said support surface attachment means to be vertically adjusted before said screw is fully engaged with said support surface, and 2) an interconnection portion;

b. an article attachment member comprising an elongated attachment bracket having opposing ends and comprising:

1) an article attachment portion for engagement with a wood-framed article, said article attachment portion further comprising attachment means to fixedly engage said wood-framed article comprising two holes through said article attachment portion of said article attachment member proximate to the ends thereof, and an equal number of screws selected to matingly engage said holes and fixedly engage said wood-framed article, and 2) an interconnection portion intended for demountable mating engagement with said interconnection portion of said support surface attachment member;

c. at least one securing assembly comprising:

1) a support surface mounted member for fixed attachment to a support surface comprising a "T"-screw, a screw with a head in the shape of a "T", 2) an article mounted member comprising:

a) means for attachment of said article mounted member to a wood-framed article comprising a plurality of holes through said means for attachment and an equal number of wood screws selected to matingly engage said holes and fixedly engage said wood-framed article, and b) means for receiving and demountably engaging said support surface mounted member comprising a slot of dimension to admit the head of said "T"-screw when said "T"-screw is aligned in a horizontal orientation, and matingly engage the head of said "T"-screw when said "T"-screw is vertically oriented; and, d. a tool for the rotational orientation of the head of said "T"-screw.

3. A system for the demountable secured attachment of a metal-framed article to a supporting surface, wherein said metal frame is constructed of metal channel molding having, in cross-section, an open-boxed portion with the opening facing rearward, and a depending rim facing inward from the outer periphery of said open-boxed portion, which system comprises:

a. a support surface attachment member comprising an elongated mounting bracket comprising:

1) a mounting portion for engagement with a support surface, said mounting portion further comprising mounting means adapted to fixedly engage said support surface, said mounting portion being vertically adjustable, and 2) an interconnection portion spaced apart from said support surface and adapted to engage said depending rim of said metal channel molding;

b. at least one securing assembly comprising a support surface mounted member for fixed attachment to a support surface comprising a "T"-screw, a screw with a head in the shape of a solid rectangle, which "T"-screw is adapted for engagement with the depending rim of said metal channel molding such that the head of said "T"-screw can be positioned within said open-boxed portion of said metal channel molding when the head of said "T"-screw is aligned in a horizontal orientation, and matingly engage said depending rim of said metal channel molding when the head of said "T"-screw is vertically oriented; and, d. a tool for the rotational orientation of the head of said "T"-screw.

* * * * *